US008281436B2

(12) United States Patent
Spahn et al.

(10) Patent No.: US 8,281,436 B2
(45) Date of Patent: Oct. 9, 2012

(54) INFLATABLE BODY SUPPORT WITH DOG-BONE-SHAPED HAND WELLS

(75) Inventors: James G. Spahn, Carmel, IN (US); Brian Conway, Carmel, IN (US); David P. Laughlin, Mooresville, IN (US)

(73) Assignee: EHOB, Inc., Indianapolis, IN (US)

( * ) Notice: Subject to any disclaimer, the term of this patent is extended or adjusted under 35 U.S.C. 154(b) by 0 days.

(21) Appl. No.: 13/176,913

(22) Filed: Jul. 6, 2011

(65) Prior Publication Data

US 2012/0005837 A1 Jan. 12, 2012

Related U.S. Application Data

(60) Provisional application No. 61/399,257, filed on Jul. 9, 2010.

(51) Int. Cl.
*A47C 27/08* (2006.01)

(52) U.S. Cl. ..... 5/706; 5/81.1 HS; 5/715; 5/703

(58) Field of Classification Search ..... 5/81.1 HS, 5/706, 715, 654, 655.3, 703, 644, 707, 932; 441/35, 40, 80
See application file for complete search history.

(56) References Cited

U.S. PATENT DOCUMENTS

| | | | | |
|---|---|---|---|---|
| 2,345,421 | A * | 3/1944 | Perry | 5/706 |
| 5,265,293 | A * | 11/1993 | Spahn et al. | 5/706 |
| 5,430,901 | A * | 7/1995 | Farley | 5/730 |
| 5,657,499 | A * | 8/1997 | Vaughn et al. | 5/654 |
| 2007/0157391 | A1 * | 7/2007 | Jackson | 5/644 |

* cited by examiner

*Primary Examiner* — Robert G Santos
*Assistant Examiner* — Richard G Davis
(74) *Attorney, Agent, or Firm* — Clifford W. Browning; Krieg DeVault LLP

(57) ABSTRACT

An improved inflatable body support with novel dog-bone-shaped hand wells that do not create material stress points when they are stretched while in use in place of the prior art oval-shaped hand wells that do create material stress points when they are stretched while in use.

2 Claims, 4 Drawing Sheets

INFLATABLE BODY SUPPORT WITH DOG-BONE-SHAPED HAND WELLS

The present application claims the benefit of U.S. Provisional Patent Application Ser. No. 61/399,257, filed Jul. 9, 2010.

The present invention generally relates to the field of reclining devices for supporting the human body, and more particularly to an improved inflatable body support that provides pressure, heat and moisture dissipation to prevent the onset of pressure sores and ulcers.

BACKGROUND OF THE INVENTION

Pressure sores, and their resulting ulcers, can begin long before a patient is lying on a hospital bed. Pressure sores can result from a person being placed upon a hard hospital transportation cart, an operating room table, a CAT scanner, a cardiac or day chair, or even a wheelchair for an extended period of time. Inflatable pressure, heat and moisture dissipating body supports, such as the one disclosed and illustrated in FIG. 1 of U.S. Pat. No. 5,265,293 to Spahn et al. ("Spahn et al.") (reproduced as Prior Art in FIG. 4 herein), are now well known in the prior art as being simple, cost effective means to provide hospital patients with effective skin care management.

The inflatable body support illustrated in FIG. 1 of Spahn et al. is formed from a pair of plastic sheets joined together about their common periphery to form a single air pressurizable chamber therebetween. The pair of plastic sheets also have a plurality of aligned holes extending therethrough with the sheets being joined together around the circumference of each hole, thereby preventing air flow from the air pressurizable chamber into the holes, and resulting in a chambered inflatable support with a plurality of holes through and through. Since heat buildup can also lead to tissue breakdown and harbor infection, air circulation is promoted by providing the plurality of holes through and through the air chamber over substantially its entire surface area where a patient's body would actually lie on the inflatable body support. These through holes also permit moisture to flow down and away from a patient, which is a particularly important feature for incontinent patients. The prior art inflatable body supports without holes through and through did not provide adequate heat and moisture dissipation.

The inflatable body support of FIG. 1 of Spahn et al. also has occlusions within the plurality of through holes about the circumference of the inflatable body support where the torso, head and limbs of a patient positioned atop the inflatable body support would not lie. These occlusions totally occlude the through holes, which thereby reduces any distension of the inflatable body support surrounding the occluded holes and effectively volume centers the air within the pressurizable air chamber that is the inflatable body support under where a patient would be laying thereon.

The chambered, air volume centering design of the prior art inflatable body supports of FIG. 1 of Spahn, et al., is designed to provide equal support to the patient's entire body, thereby reducing pressure on any one area to well below the capillary closure pressure to prevent pressure sores and ulcers from developing. Skin friction and deep tissue shear is also minimized through the use of non-abrasive materials of construction, which allows a patient supported thereon to easily move by eliminating friction or resistance. A non-porous, durable, hypo-allergenic vinyl with a flame retardant and an antimicrobial added has been a preferred prior art material to date from which to construct the inflatable body supports of FIG. 1 of Spahn et al.

The air centering, high profile design of the inflatable body supports of FIG. 1 of Spahn, et al., also decreases deep tissue shear in patients because the inflatable body support will contour to the patient's body, thus cradling the body to provide necessary support. This volume centering construction works well for relieving pressures, but it creates a high profile for the inflatable body support, which makes it more difficult for caregivers to reposition or transfer a patient laying on the inflatable body support of FIG. 1 of Spahn et al.

Referring now to Prior Art FIG. 3 of the present application, the inflatable body support of FIG. 1 of Spahn, et al., was modified to provide four (4) oval-shaped hand wells 10 positioned along each of the two longitudinal edges of the inflatable body support, which replaced occluded holes that had been at those locations. These oval-shaped hand wells 10 aided caregivers when transferring a patient laying on the inflatable body support from one substrate surface to another by providing an easy, efficient hand hold, and they further aided caregivers when they needed to "log roll" a patient from side-to-side on the inflatable body support.

The oval-shaped hand wells 10 illustrated in Prior Art FIG. 3 of the present application served well as transfer and repositioning aids. However, referring now to FIGS. 2*a* and 2*b* of the present application, when stretching forces were applied to the oval-shaped hand wells 10, the vinyl material defining the oval hand wells 10 stretched, as expected, but the stretched vinyl material also created stress points at the tangent positions of the radiuses of the oval-shaped hand wells, as illustrated in FIG. 2*b*. This lead to material fatigue at these stress points, and the material fatigue increased the high probability of material failure, including the appearance of pin holes in the material defining the oval-shaped hand wells, with a resulting compromise of the air chamber of the inflatable body support.

Also, the absence of oval-shaped hand wells in the head 11 and foot 12 of the inflatable body support of Prior Art FIG. 3 meant that when a patient was transferred or repositioned thereon, the patient's skeletal system could become torqued out of a desirable alignment when unequal side forces were applied to the oval-shaped hand wells to move the inflatable body support of Prior Art FIG. 3.

Exemplary state of the prior art inflatable body supports illustrated in Prior Art FIG. 3, and described above, are manufactured by EHOB, Inc., in Indianapolis, Ind., and are identified by its WAFFLE® trademark, which is Registered on the Principal Register of the U.S. Trademark Office.

SUMMARY OF THE INVENTION

The present invention is an improved inflatable body support with novel dog-bone-shaped hand wells that do not create material stress points when they are stretched while in use in place of the prior art oval-shaped hand wells that do create material stress points when they are stretched while in use.

One embodiment of the present invention is in combination with an inflatable body support formed from a pair of plastic sheets joined together forming an air pressurizable chamber therebetween, the sheets having a plurality of aligned holes extending therethrough with the sheets being joined together around the circumference of each hole allowing body heat and moisture to flow through each hole but preventing air flow from the chamber into each hole, thereby providing an air cushion for supporting a person positioned thereatop that dissipates pressure, heat and moisture to prevent the onset of pressure sores and ulcers, and having occlusions joined with said sheets about the circumference of a plurality of said holes over which the torso, head and limbs of a person positioned atop the inflatable body support would not lie, occluding such holes and reducing any distension of the inflatable body support surrounding the occluded holes and thereby volume centering the air within the pressurizable chamber under a person positioned atop the inflatable body support, the improvement comprising: a plurality of aligned dog-bone-shaped hand wells extending through the plastic sheets with the sheets being joined together around the circumference of each dog-bone-shaped hand well replacing a plurality of said occluded holes over which the torso, head and limbs of a person would not lie, with large radiuses on the ends of the dog-bone-shaped hand wells that eliminate the creation of shear and stress points when they are opened up under stretching stress to make a full circle, thereby focusing stretching stress equally along the entire circumference of the circle, providing thereby a hand well that withstands a greater amount of force before creating material fatigue or failure.

Another embodiment of the present invention is in combination with an inflatable body support formed from a pair of plastic sheets joined together forming an air pressurizable chamber therebetween, the sheets having a plurality of aligned holes extending therethrough with the sheets being joined together around the circumference of each hole allowing body heat and moisture to flow through each hole but preventing air flow from the chamber into each hole, thereby providing an air cushion for supporting a person positioned thereatop that dissipates pressure, heat and moisture to prevent the onset of pressure sores and ulcers, and having occlusions joined with said sheets about the circumference of a plurality of said holes over which the torso, head and limbs of a person positioned atop the inflatable body support would not lie, occluding such holes and reducing any distention of the inflatable body support surrounding the occluded holes and thereby volume centering the air within the pressurizable chamber under a person positioned atop the inflatable body support, the improvement comprising: a plurality of aligned dog-bone-shaped hand wells extending through the plastic sheets with the sheets being joined together around the circumference of each dog-bone-shaped hand well replacing a plurality of said occluded holes over which the torso, head and limbs of the person position thereatop the inflatable body support would not lie, with at least two additional dog-bone-shaped hand wells at the bottom end of the inflatable body support, each oriented at an angle of about 90 degrees to the longitudinal axis of the inflatable body support, and at least two additional dog-bone shaped hand wells at the top end of the inflatable body support, each oriented at an angle of about 65 degrees to the longitudinal axis of the inflatable body support.

DETAILED DESCRIPTION OF THE INVENTION

Figure 1:
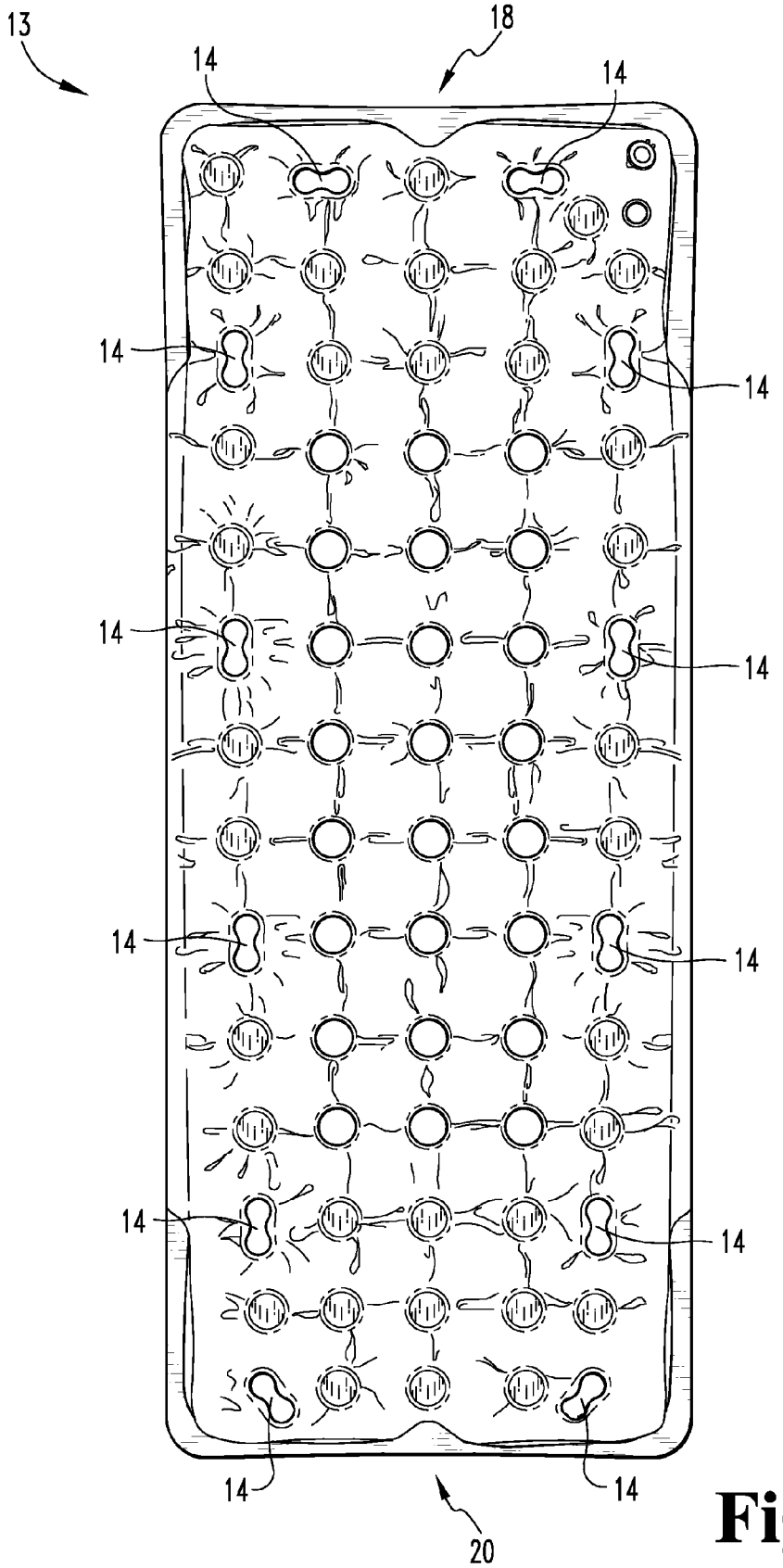
FIG. 1 is a top plan view of a preferred embodiment of the improved inflatable body support of the present invention.
Figure 2A:
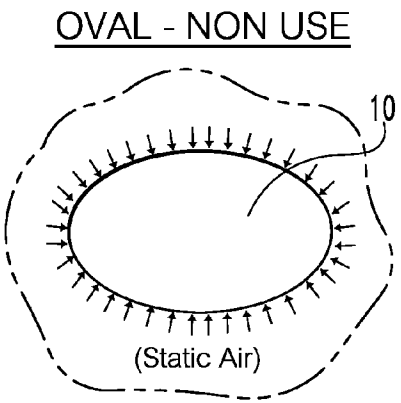
FIGS. 2*a* and 2*d* illustrate the differences between the oval-shaped hand wells of the prior art and the novel dog-bone-shaped hand wells of the present invention.
Figure 2B:
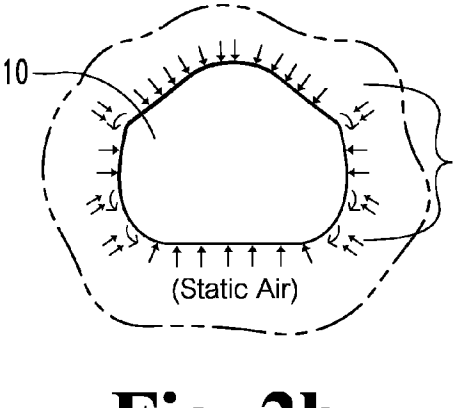
Figure 2C:
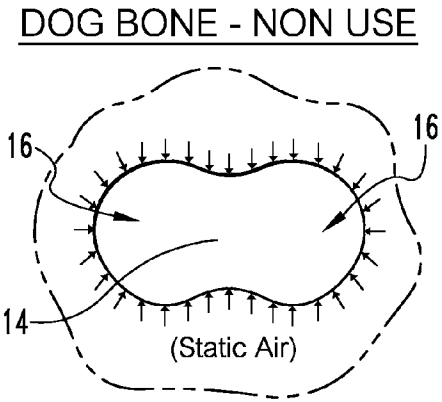
Figure 2D:
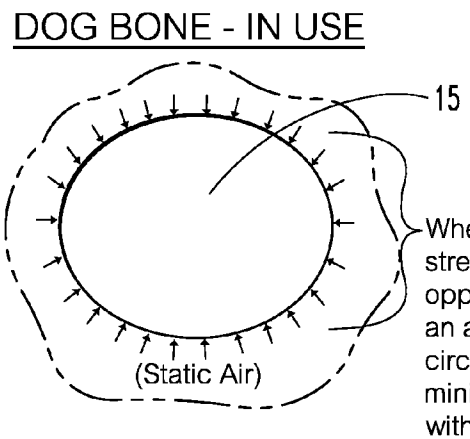

Referring now to FIGS. 1 and 2*a*-2*d*, one of the novel improvements to inflatable body supports 13 of the present invention has been to change the oval shaped hand wells of the prior art (FIG. 3) to novel dog-bone-shaped hand wells 14 illustrated in FIGS. 1 and 2*c*-2*d*. The novel dog-bone-shaped hand wells 14 of the present invention, have large radiuses 16 on their ends that combat the creation of sheer and stress points when the dog-bone-shaped hand wells are stretched, as illustrated in FIGS. 2*c* and 2*d*. When a stretching force is applied to the dog-bone-shaped hand wells 14, the material stretches, but the inside of the dog-bone-shaped hand well 14 opens up to make a full circle 15, as illustrated in FIG. 2*b*. This focuses the stretching stress equally along the entire circumference of the stretched dog-hone-shaped hand well (FIG. 2*d*) instead of concentrating the stretching stress at the tangent points of the quadrants as was the case with oval-shaped hand wells (FIG. 2*b*), which means that an exponentially greater amount of force can be applied to the dog-boned-shaped hand wells 14 before they fail, which greatly reduces the probability of material fatigue and failure.

Making the outside of the hand well in a dog-bone-shape 14, with a larger radius 16 at each end, has therefore solved the problem of the stress points present when a stretching force is applied to the oval-shaped hand wells 10 of the prior art. The larger outside radiuses 16 of the dog-bone-shaped hand wells 14 open up, which in turn brings the concave radiuses 15 in the center of the dog-bone-shaped hand wells 14 out to round out and make a complete circle (FIG. 2*d*), which relieves the stress points on the entire circumference of the complete circle.

Figure 3:
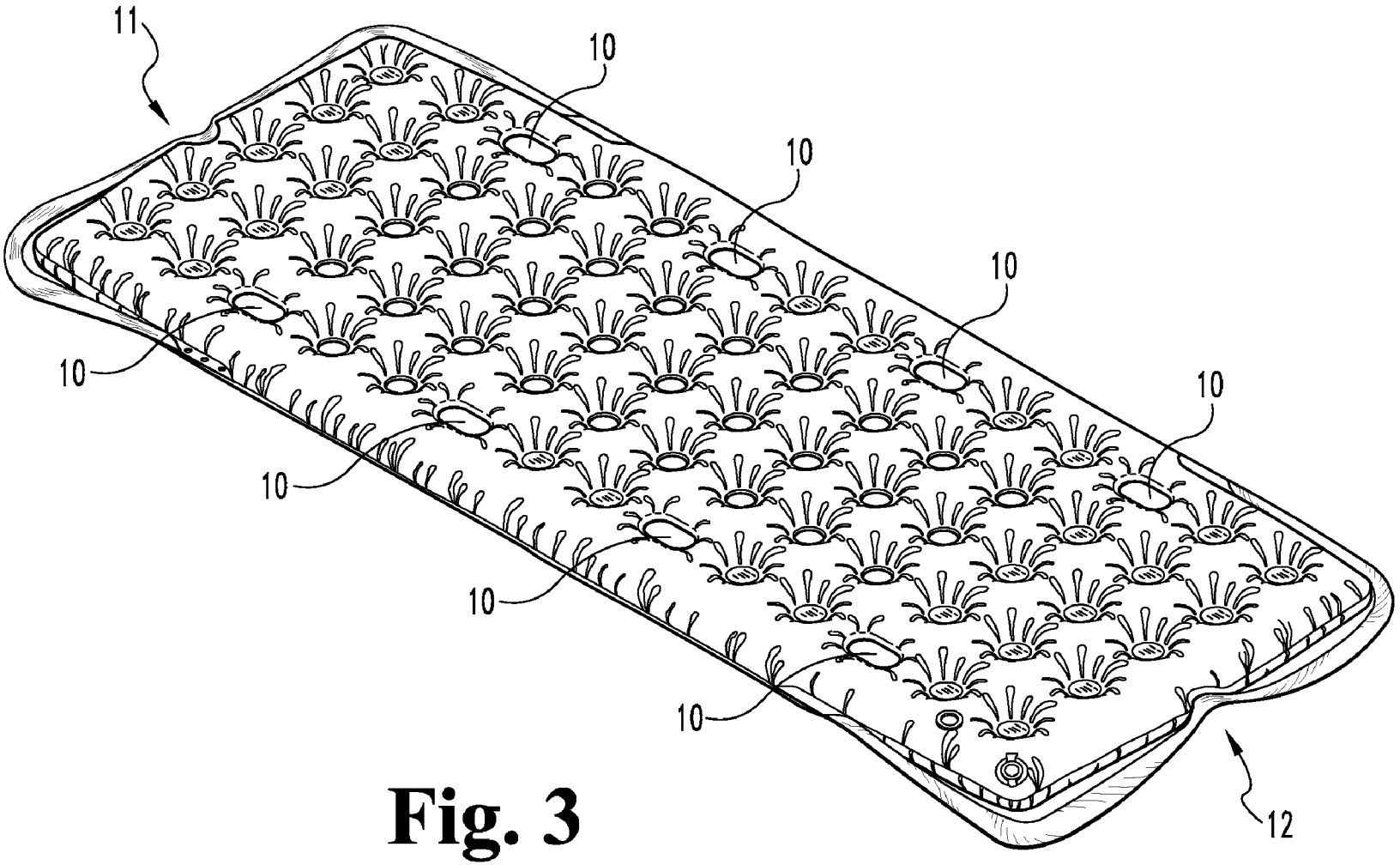
Fig. 3 (Prior Art)
FIG. 3 is a Prior Art Figure showing a perspective view of an embodiment of the Inflatable Body Support of U.S. Pat. No. 5,265,293 of Spahn et al., with four (4) prior art oval-shaped hand wells on each of its longitudinal edges.
Figure 4:
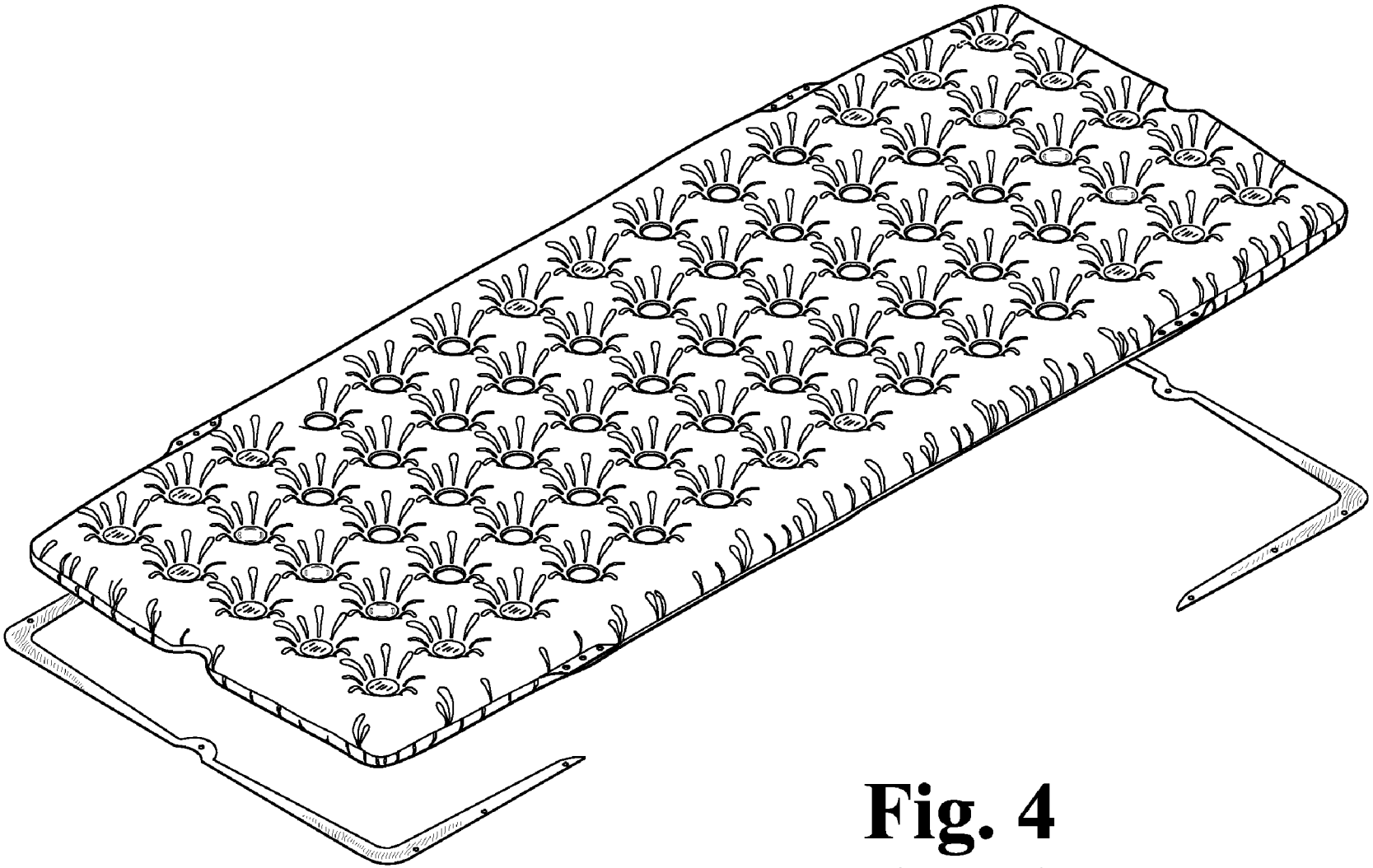
Fig. 4 (Prior Art)
FIG. 4 is a Prior Art Figure showing a perspective view of an embodiment of the Inflatable Body Support of U.S. Pat. No. 5,265,293 of Spahn et al.

Another novel improvement to the inflatable body support 13 of the present invention is the addition of four additional novel dog-bone-shaped hand wells 14 over the number of oval-shaped hand wells 10 of the prior art (Prior Art FIG. 3). Two novel dog-bone-shaped hand wells have been added at the foot 18 of the novel inflatable body support of FIG. 1 oriented perpendicular to the body support's central longitudinal axis; and two novel dog-bone-shaped hand wells oriented at 65 degree angles to the support's central longitudinal axis have been added at the head 20 of the support.

The two new dog-bone-shaped hand wells 14 added at the foot 18 of the improved inflatable body support 13 of the present invention allow caregivers to reposition the body support 13 more easily (i.e., pull the support downwards) if the body support 13 rides up on a substrate.

The two new novel dog-bone-shaped hand wells 14 oriented at 65 degree angles to the support's central longitudinal axis at the head 20 of the novel body support 13 of the present invention have multiple uses:

1. They are ergonomically placed to place a caregiver in the desired position to reposition a patient and to aid in helping a patient sit upright.
2. When transferring a patient to another substrate, the angled dog-bone-shaped hand wells 14 allow a caregiver to put equal amounts of stress across the entire skeletal system of a patient that helps keep the patient's skeletal system in line during the transfer maneuver.
3. When transferring or repositioning a patient using the novel dog-bone-shaped hand wells 14 on a 65 degree angle, they take stress off a caregiver's shoulders and reduce the risk of injury to the caregiver's rotator cup.

The novel dog-bone-shaped design of the hand wells 14 present invention also leaves extra material between the outer perimeter of the defined inflatable body support 13 and each novel dog-bone-shaped hand well 14 to give more material mass to grab onto. This further reduces the probability of material fatigue.

Another novel improvement of the improved inflatable body support 13 of the present invention is that the novel dog-bone-shaped hand wells 14 have been placed around the entire perimeter of the body support 13 (FIG. 1). The addition of four additional dog-bone-shaped hand wells 14 to the eight oval-shaped hand wells that were replaced in prior art inflatable body support of FIG. 3 is a novel improvement, because:

1. Having hand wells 14 along the entire perimeter gives caregivers additional hand well positions to grab while transferring or repositioning a patient; and
2. The additional novel dog-bone-shaped hand wells 14 of the present invention, with their openings that expand and elongate in a stress reducing fashion (FIGS. 2*e* and 2*d*), makes the novel inflatable body support 13 of the present invention more stable, overall, and results in a desirable lower profile over that of the prior art inflatable body support of Prior Art FIG. 3.

We claim:

1. In combination with an inflatable body support formed from a pair of plastic sheets joined together forming an air pressurizable chamber therebetween, the sheets having a plurality of aligned holes extending therethrough with the sheets being joined together around the circumference of each hole allowing body heat and moisture to flow through each hole but preventing air flow from the chamber into each hole, thereby providing an air cushion for supporting a person positioned thereatop that dissipates pressure, heat and moisture to prevent the onset of pressure sores and ulcers, and having occlusions joined with said sheets about the circumference of a plurality of said holes over which the torso, head and limbs of a person positioned atop the inflatable body support would not lie, occluding such holes and reducing any distension of the inflatable body support surrounding the occluded holes and thereby volume centering the air within the pressurizable chamber under a person positioned atop the inflatable body support, the improvement comprising: a plurality of aligned dog-bone-shaped hand wells extending through the plastic sheets with the sheets being joined together around the circumference of each dog-bone-shaped hand well replacing a plurality of said occluded holes over which the torso, head and limbs of a person would not lie, with large radiuses on the ends of the dog-bone-shaped hand wells that eliminate the creation of shear and stress points when they are opened up under stretching stress to make a full circle, thereby focusing stretching stress equally along the entire circumference of the circle, providing thereby a hand well that withstands a greater amount of force before creating material fatigue or failure.

2. In combination with an inflatable body support formed from a pair of plastic sheets joined together forming an air pressurizable chamber therebetween, the sheets having a plurality of aligned holes extending therethrough with the sheets being joined together around the circumference of each hole allowing body heat and moisture to flow through each hole but preventing air flow from the chamber into each hole, thereby providing an air cushion for supporting a person positioned thereatop that dissipates pressure, heat and moisture to prevent the onset of pressure sores and ulcers, and having occlusions joined with said sheets about the circumference of a plurality of said holes over which the torso, head and limbs of a person positioned atop the inflatable body support would not lie, occluding such holes and reducing any distention of the inflatable body support surrounding the occluded holes and thereby volume centering the air within the pressurizable chamber under a person positioned atop the inflatable body support, the improvement comprising: a plurality of aligned dog-bone-shaped hand wells extending through the plastic sheets with the sheets being joined together around the circumference of each dog-bone-shaped hand well replacing a plurality of said occluded holes over which the torso, head and limbs of the person position thereatop the inflatable body support would not lie, with at least two additional dog-bone-shaped hand wells at a bottom end of the inflatable body support, each oriented at an angle of about 90 degrees to the longitudinal axis of the inflatable body support, and at least two additional dog-bone shaped hand wells at a top end of the inflatable body support, each oriented at an angle of about 65 degrees to the longitudinal axis of the inflatable body support.

* * * * *